US011578463B2

(12) United States Patent
Saukkonen et al.

(10) Patent No.: US 11,578,463 B2
(45) Date of Patent: Feb. 14, 2023

(54) DOSING OF NANOCELLULOSE SUSPENSION IN GEL PHASE

(71) Applicants: Stora Enso Oyj, Helsinki (FI); Wetend Technologies Oy, Savonlinna (FI)

(72) Inventors: Esa Saukkonen, Lappeenranta (FI); Isto Heiskanen, Imatra (FI); Kaj Backfolk, Lappeenranta (FI); Jouni Matula, Savonlinna (FI); Jussi Matula, Savonlinna (FI)

(73) Assignees: Stora Enso Oyj, Helsinki (FI); Wetend Technologies Oy, Savonlinna (FI)

( * ) Notice: Subject to any disclaimer, the term of this patent is extended or adjusted under 35 U.S.C. 154(b) by 178 days.

(21) Appl. No.: 16/628,565

(22) PCT Filed: Jul. 2, 2018

(86) PCT No.: PCT/IB2018/054903
§ 371 (c)(1),
(2) Date: Jan. 3, 2020

(87) PCT Pub. No.: WO2019/008500
PCT Pub. Date: Jan. 10, 2019

(65) Prior Publication Data

US 2020/0181847 A1 Jun. 11, 2020

(30) Foreign Application Priority Data

Jul. 5, 2017 (SE) ..... 1750877-1

(51) Int. Cl.
*D21H 23/14* (2006.01)
*D21H 11/18* (2006.01)
*D21H 23/20* (2006.01)
*D21C 9/00* (2006.01)

(52) U.S. Cl.
CPC ..... *D21H 23/14* (2013.01); *D21C 9/007* (2013.01); *D21H 11/18* (2013.01); *D21H 23/20* (2013.01)

(58) Field of Classification Search
CPC ..... D21H 23/14; D21H 23/04; D21H 23/20; D21H 11/20; D21C 9/007; B01F 3/10; B01F 13/10; B01F 2003/0028; B01F 2003/0078; C08L 1/02
See application file for complete search history.

(56) References Cited

U.S. PATENT DOCUMENTS

| | | | | |
|---|---|---|---|---|
| 10,030,335 | B2 * | 7/2018 | Hietaniemi | D21H 17/375 |
| 10,214,855 | B2 * | 2/2019 | Kajanto | D21C 9/001 |
| 10,570,564 | B2 * | 2/2020 | Kajanto | D21H 11/20 |
| 2012/0107480 | A1 * | 5/2012 | Gane | D21B 1/04 426/573 |
| 2013/0047893 | A1 | 2/2013 | Heiskanen et al. | |
| 2014/0345816 | A1 | 11/2014 | Heiskanen et al. | |
| 2015/0299959 | A1 * | 10/2015 | Axrup | D21H 17/24 162/181.4 |
| 2015/0330024 | A1 * | 11/2015 | Gane | D21C 9/007 162/149 |
| 2016/0024718 | A1 | 1/2016 | Lee et al. | |
| 2016/0289894 | A1 * | 10/2016 | Kajanto | D21C 5/005 |
| 2016/0319485 | A1 * | 11/2016 | Hietaniemi | D21H 17/69 |
| 2017/0107669 | A1 * | 4/2017 | Axrup | C08B 15/02 |
| 2017/0121908 | A1 * | 5/2017 | Holtan | D21C 9/007 |
| 2017/0218567 | A1 * | 8/2017 | Kajanto | D21H 11/20 |
| 2018/0245289 | A1 * | 8/2018 | Heiskanen | D21H 19/36 |
| 2019/0040581 | A1 * | 2/2019 | Vanhatalo | D21H 11/18 |
| 2019/0048527 | A1 * | 2/2019 | Heiskanen | C08J 5/18 |
| 2020/0181847 | A1 * | 6/2020 | Saukkonen | D21H 11/18 |
| 2021/0062418 | A1 * | 3/2021 | Håkansson | D21D 1/20 |
| 2021/0189650 | A1 * | 6/2021 | Ketolainen | D21F 1/024 |
| 2021/0269981 | A1 * | 9/2021 | Karisalmi | C08H 8/00 |
| 2022/0010492 | A1 * | 1/2022 | Miikki | D21H 11/18 |
| 2022/0064390 | A1 * | 3/2022 | Backfolk | C08J 5/18 |

FOREIGN PATENT DOCUMENTS

| | | | | |
|---|---|---|---|---|
| CN | 105229228 | A | 1/2016 | |
| EP | 2824170 | A1 | 1/2015 | |
| EP | 2971347 | A1 | 1/2016 | |
| JP | H11106403 | A | 4/1999 | |
| JP | 2012522093 | A | 9/2012 | |
| JP | 2014526619 | A | 10/2014 | |
| JP | 6153679 | B1 | 6/2017 | |
| WO | WO-2010131016 | A2 * | 11/2010 | D21B 1/30 |
| WO | WO-2014140275 | A1 * | 9/2014 | D21C 9/007 |
| WO | WO-2016068787 | A1 * | 5/2016 | B01J 20/24 |
| WO | 2016102769 | A1 | 6/2016 | |

(Continued)

OTHER PUBLICATIONS

International Search Report for International Application No. PCT/IB2018/054903, dated Sep. 26, 2018 (3 pages).
E-Space English Language Abstract for EP 2971347.
Notice of Rejection Decision for Chinese Application No. 201880045352.5, dated Oct. 18, 2022, (4 pages).
English Tanslation of JP Office Action for Japanese Application No. 2020-500041, dated Nov. 1, 2022, (5 pages).

*Primary Examiner* — Jose A Fortuna
(74) *Attorney, Agent, or Firm* — Kagan Binder, PLLC

(57) ABSTRACT

A method of dosing a nanocellulose suspension in gel phase into a second suspension, wherein the method comprises the steps of: providing said nanocellulose suspension in gel phase; providing said second suspension; bringing said nanocellulose suspension in gel phase in contact with said second suspension; wherein the method comprises a step of subjecting said nanocellulose suspension in gel phase to a shear rate of more than 500 l/s, simultaneously with and/or immediately prior to the step of bringing said nanocellulose suspension in gel phase and said second suspension in contact with each other.

15 Claims, No Drawings

(56) References Cited

FOREIGN PATENT DOCUMENTS

| | | | | | |
|---|---|---|---|---|---|
| WO | WO-2016193548 | A1 * | 12/2016 | ..... | A61K 31/717 |
| WO | 2017103335 | A1 | 6/2017 | | |
| WO | WO-2019008500 | A1 * | 1/2019 | ..... | D21H 23/20 |

* cited by examiner

DOSING OF NANOCELLULOSE SUSPENSION IN GEL PHASE

CROSS-REFERENCE TO RELATED APPLICATIONS

This application claims priority to International Application No, PCT/IB2018/054903, filed Jul. 2, 2018 and titled "DOSING OF NANOCELLULOSE SUSPENSION IN GEL PHASE," which in turn claims priority from a Swedish Patent Application having serial number 1758077-1 filed Jul. 5, 2017, titled "DOSING OF NANOCELLULOSE SUSPENSION IN GEL PRASE," both of which are incorporated herein by reference in their entireties.

TECHNICAL FIELD

The present invention relates to a method of dosing a nanocellulose suspension in gel phase into a second suspension.

BACKGROUND

Nanocellulose or microfibrillated cellulose (MFC) is conventionally used in papermaking to improve strength properties or to lower porosity of the formed materials, such as web, paper, board or fiber based-composites. This is based on the fact that MFC has a high surface area (i.e. in wet, non-consolidated or hornificated form) and high amounts of reactive sites which promotes bonding between materials such as fibers, fillers, plastics, or water soluble polymers such as starch. The MFC may also act as a filling material between other materials either when used in wet end or when dosed in surface treatment applications (surface sizing, coating, printing).

Although it is recognized that MFC is hydrophilic due to the presence of electrostatic charged groups and OH groups, it might also possess a hydrophobic character which probably is due to pulp manufacturing process, composition of MFC and degree of modification of pulp or MFC (e.g. charges introduced during cooking and bleaching or the amount of hemicellulose). Extensive refining of fibers will increase the number of fibrils (surface area), and at the same time enhance its gel-like behavior. The gel strength and properties are not only related to degree of fibrillation such as surface area, but also to the type of raw material, electrolytes, solid concentration, temperatures, additives, hemicellulose, fibril dimensions and/or lignin content etc. In particular, the increased solid concentration leads to "stronger" gels which not only behave more like a solid, but also "re-dissolves" less or more slowly when re-dispersed.

In order to ensure good and efficient usage of MFC in the end product, it would be beneficial to have MFC evenly distributed so that MFC or nanocellulose are efficiently separated from each other and all the bonding/filling power is utilized. If the MFC fibrils form flocks or are agglomerated, then all potential of MFC will not be utilized. Another problem related to MFC gel or MFC agglomerates, is that the accessibility to chemicals or additives used in the process is limited or uneven (i.e. interaction between other chemicals or additives and MFC).

Conventional ways to provide an even distribution at the moment is to dilute MFC as much as possible (typically below 0.1 weight-%) before adding it to other materials or suspensions. Unfortunately, this means also that large amounts of water are required and used and in industrial applications usage of large volumes/amounts of water is e.g. technically challenging or not applicable due to economically viable reasons. In some cases, it is more convenient to dosage pulps or suspensions at higher consistency for example due to volume, i.e. chest capacity and investment costs, or because of avoiding unnecessary dilution or reduction of total solids of the suspension. The dosing of a gel-formed materials is also relevant in the case of using e.g. wet pressed MFC cakes which can have a solid above 15-20 weight-%. In such cases, dilution and mixing is required before dosing but the problem is still that the suspension quality is uneven and contains substantial amount of "gel" particles.

There is therefore a need to solve the above problems in order to be able to scale up the use of MFC in an industrial scale. One way of solving the problem is by adding highly concentrated cellulose suspension, or cellulose gels, to for instance the stock solution. These gels may for instance be formed from microfibrillated cellulose (MFC). MFC forms a gel at very low concentrations, and thus forms strong self-assemblies and strong flocculation. The flocculation can occur for both non-carboxylated and non-oxidized as well as derivatized cellulose nanofibers. The gel strength and gel behavior upon dilution we believe is different depending on the type of MFC or nanocellulose. Without being bound to any theory, we believe that non-derivatized grade e.g. only mechanically disintegrated with or without enzymatic pretreatment, leads to a MFC grade which is more prone to self-associate and cause flocs. The gels can be further affected by adding salts such as monovalent metal salts, but also divalent or multivalent salts such as $CaCl2$ or $AlCl3$. Other types of chemicals working as cross-linker can also be used. Adjustment of pH or addition of other compound such as hydrophobic polymers can also be used to control the gel point and gel behavior.

Thus one problem with these cellulose gels such as those formed from MFC is that they form very strong gels, especially if concentrated above the gel point. Dosing an MFC gel to for instance a wet end of a paper machine is very challenging since the MFC will remain in its gel form or gel particles or flocs and these will be unevenly distributed in the web. This is especially critical in thin sheet forming, such as MFC film for barrier purposes.

SUMMARY

It is an object of the present disclosure, to provide an improved method of dosing a nanocellulose suspension in gel phase, such as microfibrillated cellulose gel into a second and different suspension, in particular in papermaking and thereto related processes.

The invention is defined by the appended independent claims. Embodiments are set forth in the appended dependent claims and in the following description.

According to a first aspect there is provided a method of dosing a nanocellulose suspension in gel phase into a second suspension, wherein the method comprises the steps of: providing said nanocellulose suspension in a gel phase; providing said second suspension; bringing said nanocellulose suspension in gel phase in contact with said second suspension; wherein said nanocellulose suspension in gel phase is subjected to a shear rate of more than 500 1/s, simultaneously with and/or immediately prior to the step of bringing said nanocellulose suspension in gel phase and said second suspension in contact with each other.

The term "gel phase" or "gel" is thus related to the amount of nanocellulose in the suspension and its rheological behavior. Typically, when you increase MFC concentration, i.e.

the solid content of the suspension, the flow properties changes at some point, i.e. changing from liquid to more viscoelastic and finally viscoelastic-solid.

By this method, it is possible to achieve an even mix of the nanocellulose in the nanocellulose suspension in gel phase and the materials present in the second suspension. This might be in particular important in thin sheet forming, such when making thin barrier films comprising nanocellulose e.g. microfibrillated cellulose (MFC). It is also very important when targeting good mixing of nanocellulose, e.g. MFC at high solid contents with other materials, e.g. coating composition, surface sizing composition, or a furnish. The inventive method may thus improve processes like, paper or paperboard making, where nanocellulose is added to the head box flow. It could also improve the addition of nanocellulose to coating compositions and surface sizing compositions. It may also be applicable and improve tissue making and non-woven. The even mixture and distribution of MFC has also been found to improve the strength of the product produced. Consequently, it is possible to produce for example a paper or paperboard product with improved strength, such as improved Scott Bond and z-strength.

It was also found that the retention of fibers, chemicals and microfibrillated cellulose on a wire is improved when the microfibrillated cellulose has been subjected to a high shear force and thus being more even distributed in the product. This may be due the fact that the more even distribution of MFC makes it possible for the MFC to attach and create more bonds between both fibers and chemicals and thus be able to improve the retention.

The application of a high shear rate on the gel just before dosing or simultaneously with as the gel is dosed provides for this even distribution. The gel becomes fluidized through the high shear rate treatment, i.e. the step of subjecting the nanocellulose suspension in gel phase to a shear rate of more than 500 1/s. Re-flocculation does not occur since the gel is mixed with other materials and the microfibrils in the gel are separated by other materials.

The nanocellulose suspension in gel phase may have a G'>G", wherein the G' is higher than 0.5 Pa, or more preferably higher than 1.0 Pa and most preferably higher than 5.0 Pa when measured at frequency less than 0.1 Hz.

The nanocellulose suspension in gel phase may have a crowding factor above 60. This means that the nanocellulose suspension in gel phase preferably has a relatively high crowding factor.

According to one alternative of the first aspect the nanocellulose suspension in gel phase may have a solid content of at least 1 wt-% based on the total solid content of the nanocellulose suspension, or a solid content of at least 3 wt-% based on the total solid content of the suspension, or at least 5 wt-% based on the total solid content, when said nanocellulose suspension in gel phase is added to the second suspension.

According to the first aspect the step of subjecting said nanocellulose suspension in gel phase to said shear rate is performed in a high shear mixing device.

The shear rate may be more than 1000 1/s and more preferred more than 4000 1/s and most preferred more than 10 000 1/s.

The second suspension may comprise any one of a stock solution, a coating composition and a surface sizing composition. This means that the nanocellulose suspension in gel phase, may be effectively added in different steps of the papermaking process, for example to a stock solution or a coating composition. The second suspension preferably comprises cellulosic fibers. This means that the inventive method can be utilized in papermaking but it is not limited to such application.

According to one alternative of the first aspect the nanocellulose suspension in gel phase is subjected to said shear rate treatment step in, or directly in contact with, a dosing zone of a papermaking machine. This means that the gel, may be dosed, for instance into a stock solution, i.e. furnish, when it is still fluidized by the high shear rate treatment.

The gel may be brought to a fluidized state through said high shear rate treatment step, and wherein said fluidized gel is then brought into contact with said second suspension within less than 1 second, preferably within less than 30 μseconds, preferably less than 15 μseconds, preferably less than 10 μseconds, or even more preferred less than 5 μseconds. This means that the time period from when the gel has been subjected to the high shear rate treatment and is brought into contact with the second suspension is short enough to ensure that the nanocellulose has not started to re-flocculate.

The second suspension may be introduced into said high shear mixing device when said gel is subjected to said shear treatment. This may provide for an even more effective mixing of the fluidized gel and the suspension into which the nanocellulose is to be dosed.

The temperature of the nanocellulose suspension in gel phase gel may be at least 25° C., or at least 30° C. or at least 35° C.

The high shear mixing device may be any one of a modified Trump jet apparatus, high pressure liquid injection apparatus, ultrasound apparatus, high pressure drop apparatus, or high shear mixing apparatus, or any combinations of these By modified Trump jet apparatus is meant a conventional Trump jet which has been modified to provide a high enough shear rate or shear forces. The conventional Trump jet equipment available provides for an effective mixing of streams of material, but is not designed to provide the high shear forces necessary in the present invention in order to fluidize the gel comprising nanocellulose. Ultrasound apparatus may be for instance ultrasonic mixing device. The desired shear rate can also be produced with moving or rotating elements, such as cavitron, a continuous high-shear homogenizer mixing system.

The shear mixing device may further comprise tubing or pipes having rough walls. The roughness of the pipes or tubes may provide for even higher, and thus more effective shear rates or shear forces, since when a fluid is flowing in a circular pipe the fluid in the center of the pipe is moving faster than the fluid near the walls, for both laminar and turbulent flows.

The nanocellulose may comprise any one of a microfibrillated cellulose or a nanocrystalline cellulose, or fine materials extracted from the paper machine or stock systems.

The nanocellulose suspension in gel phase may further comprise precursor materials, such as any one of a debonder, a gas or nanoparticles.

The nanocellulose suspension in gel phase may comprise additives or chemicals, such as any one of a dispersion agent, gelling agent, and a foaming agent. By adding functional chemicals, a better dispersing of MFC comprising e.g. salts or polyelectrolytes or other nanomaterials such as nanopigments or sols (e.g. silica sols) may be achieved. Depending on the additives, stronger association can be formed between particles, polymers, fibrils leading to a gel which is even more difficult to disperse the dilution water might comprise e.g. papermaking chemicals or acid or bases. The functional chemicals may be added to the nanocellulose suspension in gel phase at a fluidized state, and this mixture may be added to the second suspension.

According to one alternative of the first aspect, during the step of subjecting said nanocellulose suspension in gel phase to a high shear rate said gel is diluted. This may improve the dispersing effect.

A fluidization time of the gel comprising nanocellulose may be more than 0.001 seconds, preferably more than 0.005 or more preferred more than 0.01 seconds, or most preferred more than 0.05 s. By fluidization time is meant the time period during which the gel is subjected to the high shear rate or shear forces. A longer time period is preferred in order to reach the desired fluidization of the gel.

The method of the first application may be applied in, i.e. used for, any one of papermaking, paperboard making, including coating, surface sizing and wet end dosing and in manufacture of thin films comprising nanocellulose, or in manufacture of translucent films or substrates/laminates thereof or in tissue manufacturing applications or nonwoven manufacturing applications.

In certain applications the use of MFC is more sensitive and dependent on mode of dosing. The inventive method allows for an efficient dosing even in such applications.

DESCRIPTION OF EMBODIMENTS

According to one embodiment of the inventive method a nanocellulose suspension in gel phase is dosed into a second suspension wherein said second suspension preferably has a lower solid content than the nanocellulose suspension in gel phase. The nanocellulose suspension in gel phase or highly concentrated suspension comprising fibrous material, also called a "high solid content suspension" of nanocellulose, which hereinafter is called a "gel", "nanocellulose gel" or "MFC gel". The second suspension is preferably an aqueous based suspension.

The present invention could be performed in the wet end of a paper making process, for instance into the stock solution. In papermaking, the nanocellulose is usually added in the wet end and short circulation prior to the head box. However, according to alternative embodiments the gel may also be added to long circulation or e.g. during beating of fibers or adding microfibrillated cellulose (MFC) into surface sizes or coating dispersion (after or under preparation of those). The second suspension preferably has a solid content in the range of 0.05 to 75 wt-% based on the total solid content of the suspension. If the second suspension further comprises cellulosic fibers, i.e. the second suspension may be a stock solution, the solid content is preferably between 0.05-10 wt-% based on the total solid content of the suspension. If the second suspension is a surface sizing composition or coating composition the solid content of the second suspension is preferably between 5-75 wt-% based on the total solid content of the suspension.

The nanocellulose suspension in gel phase may be defined by its gel properties or a high crowding factor.

Gels may be defined as a form of matter which is intermediate between solid and liquid and exhibits mechanical rigidity. The shear modulus G, describes the rheological state of the fiber network in the gel or gel phase. The most commonly used definition of gel is a rheological one, obtained from dynamic viscometry. According to this definition, a gel is a viscoelastic system with a 'storage modulus' (G') larger than the 'loss modulus' (G"). Typically, the gel phase may be defined using a rheometer and by determining G' the elastic response and G" which is the viscous response. The G' and G" are determined at a given pH, preferably around 7-8, and given temperature preferable 23° C. and at a controlled ionic strength such as 0.01 NaCl. Pre-shearing of samples and surface roughness and composition of the measuring systems may influence the values. Typically, the rheometer are equipped with cup-cylinder or plate-plate geometries. Further, the gel strength is not linearly dependent on MFC concentration. There are also models on how to estimate critical concentration for fibril entanglement to start.

The gel may be defined by G'>G" and the loss/phase angle δ. These parameters are very important for the rheological characterization of gels. Essentially, solid characteristics are denoted by G' while G" indicates liquid characteristics. For a weak gel, G'>G", and thus junction zones can be readily destroyed even at very low shear rate and the network structure is destroyed. For strong gel, G'>>G", and both are independent of frequency; lower tan δ values (<0.1) are observed in this case.

According to one embodiment the G' for the gel phase is defined or determined to higher than 0.5 Pa, or more preferably higher than 1.0 Pa and most preferably higher than 5.0 Pa when measured at frequency less than 0.1 Hz. The elastic response is now dependent on the concentration of the suspension.

The gel, or hydrogel, is usually formed by weak association between the fibrils and formation of fibril-fibril network (or fiber-fibril) when water is included and "bound to the network". The exact solid content value for the nanocellulose suspension in gel phase, will be influenced by the above factors affect the gel point and gel behavior.

The nanocellulose suspension in gel phase may also defined by the crowding number or crowding factor (N), is a very useful parameter to indicate the degree of fiber contact in a fiber network. The crowding factor is used by as a parameter to divide fiber suspensions of different degrees of flocculation into different regimes. Each regime covers a range of values for the crowding factor. When N<1, no fiber network can be formed, and all fibers are free to move relative to one another. As all the fibers are free to move both by rotation and translation, they occasionally collide and for a very short moment remain together. With increasing values of N, the fibers have a stronger tendency to collide by translation and, as N becomes larger, collisions also take place as a result of rotational motion. When N=60 the number of contact points per fiber is approximately three, which is enough for a coherent fiber network to be established. The fibers are then no longer free to move relative to one another, either by rotation, or by translation. The fibers are inter-locked in a bent condition, with the frictional forces at the contact points between the fibers giving the network its mechanical strength. When the value of the crowding factor exceeds 60, a fiber network of considerable strength has been established. The reason why N>60 is needed is that, for a fiber to be completely locked into the fiber network, the contact points must be arranged in an alternate manner.

The crowding factor may be expressed as:

$$N \approx \frac{5C_m L^2}{\omega}$$

where $C_m$ is the mass concentration expressed as a percentage, L is the average fiber length in meters, and w is the coarseness (kg/m) (Kerekes and Schell 1992).

If the consistency of the nanocellulose suspension in gel phase, or the nanocellulose gel is 0.5%, and the MFC average coarseness 0.01 mg/m and the MFC average fibril length 0.5 mm the crowing number would be 62.5. See table 1 and 2 below for different crowding factors depending on different characteristics of the nanocellulose or MFC (as disclosed in the tables). The fibril lengths in Table 1 and 2 are estimated based on commercial fiber analyzers, for example Valmet FS5 length weighted average.

TABLE 1

| Crowding factor | | | | |
|---|---|---|---|---|
| MFC consistency % | 1.0 | 0.5 | 0.25 | 0.1 |
| MFC coarseness mg/m | 0.01 | 0.01 | 0.01 | 0.01 |
| Fibril length mm | 0.5 | 0.5 | 0.5 | 0.5 |
| Crowding factor | 125 | 62.6 | 31.5 | 12.5 |

TABLE 2

| Crowding factor | | | | |
|---|---|---|---|---|
| MFC consistency % | 1.0 | 0.5 | 0.25 | 0.1 |
| MFC coarseness mg/m | 0.005 | 0.005 | 0.005 | 0.005 |
| Fibril length mm | 0.5 | 0.25 | 0.35 | 0.25 |
| Crowding factor | 250 | 62.5 | 61.25 | 12.5 |

According to one embodiment the crowding factor of the gel phase is above 60. The crowding factor may preferably be above 61, or even more preferably above 62. The crowding factor may be in the range of 60 to 15000.

The fibers will not crowd if the fluid viscous forces acting on individual fibers are large, i.e. if the fibers follow the fluid. This phenomenon is governed by the fiber Reynolds Number, $Re_F$.

$$Re_F = \frac{\rho \cdot d \cdot G_e \cdot L}{\mu}$$

Where ρ is the fluid density, kg/m$^3$, $G_e$ is the shear rate, s$^{-1}$, L the fiber length and μ the fluid dynamic viscosity, Pa s. The Reyonolds number reflects the ratio of inertial forces to viscous forces acting upon the fiber. When ReF>>1, no flocculation occurs. The rheological properties thus illustrate how the suspension behaves at high shear forces. Rheological properties are shear dependent (dynamic measure), i.e. a given force is needed to break down the structure in order to get the desired effect.

According to one embodiment the nanocellulose suspension in gel phase has a solid content above 1 wt-% based on the total solid content of the nanocellulose suspension when added to the second suspension, preferably a solid content above 3 wt-%, or even more preferably a solid content above 5 wt-%. The solid content of the nanocellulose suspension in gel phase added may preferably be between 3-25 wt-% based on the total solid content of the nanocellulose suspension, even more preferably between 3-10 wt-% based on the total solid content of the suspension.

According to the inventive method the nanocellulose suspension in gel phase is subjected to a high shear rate, or high shear forces just prior to dosing into a second suspension, or flow of the second suspension. The SI unit of measurement for shear rate is s$^{-1}$, expressed as reciprocal seconds. The shear rate is defined as time of the scale of the shear forces can be between 1000-10000 1/s.

By high shear rate in this respect is meant a shear rate of at least more than 500/s, or more than 1000 1/s, or more preferred more than 4000 1/s, and most preferred more than 10 000 1/s.

By subjecting the gel to the high shear rate the gel preferably becomes fluidized, or is brought into a fluidized state. This means that the nanocellulose suspension in gel phase is added to the second suspension in a fluidized state.

According to one embodiment the nanocellulose suspension in gel phase is subjected to the high shear rate during a period of time which can be called the fluidization time, for at least 0.001 seconds, preferably more than 0.005 seconds or more preferred at least 0.01 seconds, or most preferred at least 0.05 s.

The high shear rate may be provided by a high shear mixing device.

The high shear mixing device may be any one of a modified Trump jet apparatus, high pressure liquid injection apparatus, ultrasound apparatus, high pressure drop apparatus. By modified Trump jet apparatus is meant a conventional Trump jet which has been modified to provide a high enough shear rate or shear forces. The conventional Trump jet equipment available provides for an effective mixing of streams of material, but is not designed to provide the high shear forces necessary in the present invention in order to fluidize the gel comprising nanocellulose. Ultrasound apparatus may be for instance ultrasonic mixing device. The high pressure injection devices may for instance be narrowed channels or capillaries.

The desired shear rate can also be produced with moving or rotating elements, such as cavitron.

The high shear mixing device may also comprise pipes or tubing having rough walls. In a turbulent flow, the friction, i.e. the roughness of the pipe walls will thus increase the frictional pressure drop. The necessary relative roughness as given in ε/D can be calculated based on the dimensions of the pipe, and the liquid flow.

The high shear rate operation is preferably performed in the proximity of where the nanocellulose suspension in gel phase is to be dosed, a so called dosing zone. Preferably the fluidized gel is brought into contact with the second suspension within less than 1 second, preferably within less than 30 μseconds, preferably less than 15 μseconds, preferably less than 10 μseconds, or even more preferred less than 5 μseconds.

The temperature of the nanocellulose suspension in gel phase may be at least 25° C., or at least 30° C. or at least 35° C.

The nanocellulose suspension in gel phase may also comprise a precursor in the form of debonder, a gas or a nanoparticle. The combination of chemical and mechanical approach enables a higher solid content of the gel. These materials can be any type of polymers or surface active polymer or chemicals that act as debonders or dispersing agents, i.e. prevents re-flocculation of the fibrils. In some cases, it is not possible to add dispersant to MFC and prevent re-flocculation. Strong shearing is needed and then the debonders or dispersants can be added.

The gel may also comprise active or functional additives or chemicals, such as any one of a dispersion agent, gelling agent, and a foaming agent. Other examples of additives that could be co-added with MFC are e.g. dyes, optical brighteners (OBA), hemicellulose e.g. xylan, dispersants such a sodium polyacrylate.

According to one embodiment the functional chemicals may be added into nanocellulose suspension in gel phase at a fluidized state, and this mixture may simultaneously at fluidized state be added to the second suspension.

During the high shear mixing the gel may be diluted, which improves the dispersing effect. By adding water or any other dilution liquid during the high shear mixing of the gel the dispersion of the gel is improved.

The nanocellulose may be microfibrillated cellulose or a nanocrystalline cellulose, or fine materials extracted from the paper machine or stock systems. Such fine materials may for instance be OCC based fines or similar materials. Microfibrillated cellulose (MFC) shall in the context of the patent application mean a nano scale cellulose particle fiber or fibril with at least one dimension less than 100 nm. MFC comprises partly or totally fibrillated cellulose or lignocellulose fibers. The liberated fibrils have a diameter less than 100 nm, whereas the actual fibril diameter or particle size distribution and/or aspect ratio (length/width) depends on the source and the manufacturing methods. The smallest fibril is called elementary fibril and has a diameter of approximately 2-4 nm (see e.g. Chinga-Carrasco, G., *Cellulose fibres, nanofibrils and microfibrils: The morphological sequence of MFC components from a plant physiology and fibre technology point of view, Nanoscale research letters* 2011, 6:417), while it is common that the aggregated form of the elementary fibrils, also defined as microfibril (Fengel, D., *Ultrastructural behavior of cell wall polysaccharides*, Tappi J., March 1970, Vol 53, No. 3), is the main product that is obtained when making MFC e.g. by using an extended refining process or pressure-drop disintegration process. Depending on the source and the manufacturing process, the length of the fibrils can vary from around 1 to more than 10 micrometers. A coarse MFC grade might contain a substantial fraction of fibrillated fibers, i.e. protruding fibrils from the tracheid (cellulose fiber), and with a certain amount of fibrils liberated from the tracheid (cellulose fiber).

There are different acronyms for MFC such as cellulose microfibrils, fibrillated cellulose, nanofibrillated cellulose, fibril aggregates, nanoscale cellulose fibrils, cellulose nanofibers, cellulose nanofibrils, cellulose microfibers, cellulose fibrils, microfibrillar cellulose, microfibril aggregrates and cellulose microfibril aggregates. MFC can also be characterized by various physical or physical-chemical properties such as large surface area or its ability to form a gel-like material at low solids (1-5 wt %) when dispersed in water. The cellulose fiber is preferably fibrillated to such an extent that the final specific surface area of the formed MFC is from about 1 to about 200 m2/g, or more preferably 50-200 m2/g when determined for a freeze-dried material with the BET method.

Various methods exist to make MFC, such as single or multiple pass refining, pre-hydrolysis followed by refining or high shear disintegration or liberation of fibrils. One or several pre-treatment step is usually required in order to make MFC manufacturing both energy efficient and sustainable. The cellulose fibers of the pulp to be supplied may thus be pre-treated enzymatically or chemically, for example to reduce the quantity of hemicellulose or lignin. The cellulose fibers may be chemically modified before fibrillation, wherein the cellulose molecules contain functional groups other (or more) than found in the original cellulose. Such groups include, among others, carboxymethyl (CMC), aldehyde and/or carboxyl groups (cellulose obtained by N-oxyl mediated oxydation, for example "TEMPO"), or quaternary ammonium (cationic cellulose). After being modified or oxidized in one of the above-described methods, it is easier to disintegrate the fibers into MFC or nanofibrillar size or NFC.

The nanofibrillar cellulose may contain some hemicelluloses; the amount is dependent on the plant source. Mechanical disintegration of the pre-treated fibers, e.g. hydrolysed, pre-swelled, or oxidized cellulose raw material is carried out with suitable equipment such as a refiner, grinder, homogenizer, colloider, friction grinder, ultrasound sonicator, fluidizer such as microfluidizer, macrofluidizer or fluidizer-type homogenizer. Depending on the MFC manufacturing method, the product might also contain fines, or nanocrystalline cellulose or e.g. other chemicals present in wood fibers or in papermaking process. The product might also contain various amounts of micron size fiber particles that have not been efficiently fibrillated.

MFC is produced from wood cellulose fibers, both from hardwood or softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper. The above described definition of MFC includes, but is not limited to, the new proposed TAPPI standard W13021 on cellulose nanofibril (CMF) defining a cellulose nanofiber material containing multiple elementary fibrils with both crystalline and amorphous regions, having a high aspect ratio with width of 5-30 nm and aspect ratio usually greater than 50.

According to one alternative the MFC is produced and used as a never dried material. This reduces problems with hornification of the cellulose before calendering. The MFC may be produced from never dried pulp, and the MFC is not subsequently dried. Further to this the use of non-hornificated MFC provides for a web or film which is more easily plasticized during calendaring and hence, the desired densification and caliper effect may be achieved.

In the final product, i.e. a film, the formation and evenness of the final product e.g. translucent of the film is clearly improved. Dosing gel-like material without exposing the material to high shear forces will definitely increase risks of MFC-rich and MFC-poor areas in the web.

The flocs of MFC can be identified from the end product which in turns leads to reduced mechanical properties or e.g. reduced optical or barrier properties.

Example

Tests on a pilot paperboard machine were done and two board samples were produced. Both samples comprise MFC and bleached CTMP and they both have a grammage of 150 gsm.

Density was measured in accordance with ISO 534:2005, Scott Bond was measured in accordance with TAPPI UM-403 and z-strength was measured in accordance with SCAN-P 80:98

Board 1:

Microfibrillated cellulose in an amount of 20 kg/t was added at a consistency of 2.3% to a furnish comprising bleached CTMP. The MFC was subjected to a shear force of 5000 1/s in a Trump jet for a period of about 0.1 seconds prior to addition to the furnish. A paperboard ply was thereafter produced from said MFC and furnish mixture. The board produced had a density of 313 kg/m$^3$ and a Scott Bond of 142 MPa, a z-strength of 225 kPa and the wire retention were 98.8%.

Board 2:

As a comparative sample microfibrillated cellulose in an amount of 20 kg/t was added at a consistency of 2.3% to a furnish comprising bleached CTMP. The MFC were subjected to a MFC at a shear rate below 100 1/s directly prior to addition to the furnish. A paperboard ply was thereafter produced from said MFC and furnish mixture. The board produced had a density of 318 kg/m$^3$ and a Scott Bond of 106 MPa, a z-strength of 215 kPa and the wire retention were 96.1%.

It is clear from the results from the tests that by subjecting the MFC to high shear forces before addition and mixing with a furnish, results in a board with higher strength. It was found that both the Scott Bond and the z-strength of the board increased. Furthermore, it was also found that the retention on the wire was improved.

In view of the above detailed description of the present invention, other modifications and variations will become apparent to those skilled in the art. However, it should be apparent that such other modifications and variations may be effected without departing from the spirit and scope of the invention.

The invention claimed is:

1. A method of dosing a nanocellulose suspension in gel phase into a second suspension, wherein the method comprises the steps of:

providing said nanocellulose suspension in gel phase;

providing said second suspension wherein said second suspension is selected from a cellulose stock solution, a coating composition and a surface sizing composition;

carrying out a high shear rate treatment step comprising subjecting said nanocellulose suspension in gel phase to a shear rate of more than 500 1/s in a high shear mixing device, wherein said nanocellulose suspension in gel phase is brought to a fluidized state through said high shear rate treatment step; and bringing said nanocellulose suspension in gel phase and said second suspension in contact with each other within less than 1 second of said high shear rate treatment step wherein said high shear mixing device is any one of a modified Trump jet apparatus, high pressure liquid injection apparatus, ultrasound apparatus, and a high pressure drop apparatus.

2. The method as claimed in claim 1, wherein the nanocellulose suspension in gel phase has a G'>G", wherein the G' is higher than 0.5 Pa when measured at frequency less than 0.1 Hz.

3. The method as claimed in claim 1, wherein the nanocellulose suspension in gel phase has a crowding factor above 60.

4. The method as claimed in claim 1, wherein the nanocellulose suspension in gel phase has a solid content of 1 wt % to 25 wt % based on the total solid content of the suspension when said nanocellulose suspension in gel phase is added to the second suspension.

5. The method as claimed in claim 1, wherein said shear rate is more than 1000 1/s.

6. The method as claimed in claim 1, wherein said nanocellulose suspension in gel phase is subjected to said shear rate treatment step in, or directly in contact with, a dosing zone of a papermaking machine.

7. The method as claimed in claim 1, wherein said second suspension is introduced into said high shear mixing device when said nanocellulose suspension in gel phase is subjected to said shear treatment.

8. The method as claimed in claim 1, wherein the temperature of the nanocellulose suspension in gel phase is at least 25° C.

9. The method as claimed in claim 1, wherein said nanocellulose comprises any one of a microfibrillated cellulose or a nanocrystalline cellulose, or cellulose stock systems.

10. The method as claimed in claim 1, wherein said nanocellulose suspension in gel phase further comprises precursor materials for preventing re-flocculation selected from the group consisting of any one of a debonder, a gas, and nanoparticles.

11. The method as claimed in claim 1, wherein the nanocellulose suspension in gel phase further comprises additives or chemicals.

12. The method as claimed in claim 1, wherein during the step of subjecting said nanocellulose suspension in gel phase to a high shear rate said nanocellulose suspension in gel phase is diluted.

13. The method as claimed in claim 1, wherein a fluidization time of the nanocellulose suspension in gel phase is more than 0.001 seconds.

14. The method as claimed in claim 1 applied in any one of papermaking, paperboard making, including coating, surface sizing and wet end dosing and in manufacture of thin films comprising nanocellulose, or in manufacture of translucent films or substrates/laminates thereof or in tissue manufacturing applications or nonwoven manufacturing applications.

15. The method as claimed in claim 11, wherein the additives or chemicals are selected from the group consisting of any one of a dispersion agent, gelling agent, and a foaming agent.

* * * * *